US008684011B2

(12) United States Patent
Ruckart

(10) Patent No.: US 8,684,011 B2
(45) Date of Patent: Apr. 1, 2014

(54) SYSTEMS AND METHODS FOR COMBING, DRYING, AND STRAIGHTENING HAIR

(76) Inventor: John P. Ruckart, Atlanta, GA (US)

( * ) Notice: Subject to any disclaimer, the term of this patent is extended or adjusted under 35 U.S.C. 154(b) by 0 days.

(21) Appl. No.: 13/290,085

(22) Filed: Nov. 5, 2011

(65) Prior Publication Data

US 2012/0048289 A1 Mar. 1, 2012

Related U.S. Application Data

(63) Continuation of application No. 12/252,567, filed on Oct. 16, 2008, now Pat. No. 8,056,568.

(51) Int. Cl.
*A45D 24/04* (2006.01)
*A45D 7/00* (2006.01)

(52) U.S. Cl.
USPC ..... 132/200; 132/136; 132/142

(58) Field of Classification Search
USPC ..... 132/136, 210, 212, 213, 219, 107, 108, 132/109, 116, 120, 126, 127, 129, 137–142, 132/148, 150, 155, 156, 158–161, 901, 132/200; 15/117, 159.1, 160, 186, 187, 15/188, 201; D28/22, 28; 34/95, 96; 119/611, 613, 615, 616, 617, 618, 619, 119/625, 632; 401/127; 222/192
See application file for complete search history.

(56) References Cited

U.S. PATENT DOCUMENTS 633,457 A * 9/1899 Hotze ..... 132/111
1,169,028 A * 1/1916 Grove ..... 132/111
1,528,775 A * 3/1925 Lebold ..... 132/136
1,614,631 A 1/1927 Sendlbeck
RE16,546 E * 2/1927 Parker ..... 132/131
2,317,485 A * 4/1943 Rider ..... 15/167.1
2,334,737 A * 11/1943 Woodruff ..... 132/134
2,425,435 A 8/1947 McArthur
2,463,893 A 3/1949 Marini
2,481,403 A * 9/1949 Di Zazzo ..... 132/124
2,533,067 A 12/1950 Taren et al.
2,566,965 A * 9/1951 Shaw ..... 132/155
2,626,618 A 1/1953 Collision
2,915,071 A * 12/1959 Watkins ..... 132/213.1
3,216,428 A 11/1965 Hallnan
3,444,866 A * 5/1969 Battaglia ..... 132/126
3,459,199 A * 8/1969 Connell ..... 132/119.1
3,464,427 A * 9/1969 Abraham ..... 132/136
3,575,183 A * 4/1971 Tanner, Sr. ..... 132/160
3,603,324 A * 9/1971 Cutrone ..... 132/136
3,638,665 A * 2/1972 Staffas, Sr. ..... 132/129
3,696,818 A 10/1972 Weber
4,008,726 A * 2/1977 DiGiuseppe ..... 132/136

(Continued)

OTHER PUBLICATIONS

Infiniti hair designer by Conair; online at http://infiniti.conair.com/share/default/content/man/38_manual.pdf.

*Primary Examiner* — Vanitha Elgart
(74) *Attorney, Agent, or Firm* — Crose Law LLC; Bradley D. Crose

(57) ABSTRACT

The technology described herein provides systems and methods for combing, drying, and straightening hair with a device having one or more rows of teeth. Additionally, this technology provides for an adjustable tension mechanism that provides for the compression of hair, thus wringing it of water and providing the ability for a user to also straighten his or her hair. Furthermore, this technology provides for combing, drying, and straightening hair without utilizing an electric or heating means.

18 Claims, 9 Drawing Sheets

(56) References Cited

U.S. PATENT DOCUMENTS

| | | | | | |
|---|---|---|---|---|---|
| 4,364,142 | A | * | 12/1982 | Pangle | 15/117 |
| 4,421,129 | A | | 12/1983 | Wingard | |
| 4,475,563 | A | * | 10/1984 | Martin | 132/136 |
| 4,807,652 | A | * | 2/1989 | Bachrach | 132/137 |
| 4,984,590 | A | * | 1/1991 | Bachtell | 132/161 |
| 4,996,996 | A | * | 3/1991 | Hirsh | 132/160 |
| 5,062,435 | A | | 11/1991 | Ohtsuka | |
| 5,449,007 | A | | 9/1995 | Arnhols | |
| 5,657,775 | A | * | 8/1997 | Chou | 132/125 |
| 5,694,953 | A | * | 12/1997 | Stephan et al. | 132/160 |
| 5,791,354 | A | * | 8/1998 | Maznik | 132/136 |
| 6,189,540 | B1 | * | 2/2001 | Stovall et al. | 132/139 |
| 6,308,717 | B1 | * | 10/2001 | Vrtaric | 132/200 |
| 6,827,039 | B1 | * | 12/2004 | Nelson | 119/604 |
| 2004/0045569 | A1 | * | 3/2004 | Chan | 132/118 |
| 2005/0241661 | A1 | | 11/2005 | Eddinger et al. | |
| 2006/0130865 | A1 | | 6/2006 | Blyden | |
| 2007/0079842 | A1 | * | 4/2007 | Glynn et al. | 132/108 |
| 2008/0127989 | A1 | * | 6/2008 | Chapman et al. | 132/118 |

* cited by examiner

SYSTEMS AND METHODS FOR COMBING, DRYING, AND STRAIGHTENING HAIR

CROSS-REFERENCE TO RELATED APPLICATION(S)

The present non-provisional patent application is a continuation of U.S. patent application Ser. No. 12/252,567, which is entitled "SYSTEMS AND METHODS FOR COMBING, DRYING, AND STRAIGHTENING HAIR", which was filed on Oct. 16, 2008, and which is incorporated in full by reference herein.

FIELD OF THE INVENTION

The technology described herein relates generally to systems and methods for combing, drying, and straightening hair. More specifically, the technology described herein relates to systems and methods for hair combing devices having at least one row of teeth and an adjustable hair compression mechanism to remove water. Furthermore, this technology relates to systems and methods for combing, drying, and straightening hair that do not utilize an electric or heating means.

BACKGROUND OF THE INVENTION

Persons having long hair generally spend a significant amount of time drying and styling their hair after it has been washed. This drying process typically includes the use of an electric hair dryer or similar heating or styling means. Additionally, once dry, many persons desire to straighten their hair utilizing an electric straightening device or a flat iron. Each of these processes is time consuming, utilizes electricity, and generates heat. Furthermore, systems requiring a power source are generally not convenient, compact, or easily transportable.

Hair combs, drying devices, and straightening devices are well known in the art. However, there are many deficiencies with these known systems and methods. Many such devices require an electrical power source and generate unnecessary and wasted heat. Other known devices do not provide the means to allow a user to adjust a variable tension mechanism between the rows of teeth and, thus, the resultant varied degree of hair compression.

The following patents and published patent applications are known in the art.

U.S. Published Patent Application No. 2006/0130865, filed by Blyden and published on Jun. 22, 2006, discloses a hair comb having hot compressing teeth, which in an open mode are shrouded by cooler combing teeth designed to encapsulate hair, and in a triggered mode collapse toward each other to compress the hair confined between the cooler teeth. The compressing teeth are mounted to a collapsible mechanism actuated by the comb's user. Various means may be utilized to transfer thermal energy to the heated teeth, and to allow the combing teeth to remain at a lower temperature.

U.S. Published Patent Application No. 2005/0241661, filed by Eddinger et al. and published on Nov. 3, 2005, discloses a hand-held comb that has a set of fine teeth and a set of coarse teeth joined by a center section. The center section preferably has an opening large enough for a finger. The fine teeth and coarse teeth extend in opposite directions away from a longitudinal axis. Some or all of the teeth can have at least one undulation, to remove loose hair and at least some of the teeth can have barbs, to remove partially cut hair strands. The teeth can have sharp edges, which also remove partially cut hair strands.

U.S. Published Patent Application No. 2004/0045569, filed by Chan and published on Mar. 11, 2004, discloses a hair care device including hair combing means, said hair combing means including a plurality of combing teeth and means for adjusting effective teeth spacing between adjacent combing teeth, characterized in that at least some of said combing teeth being thermally conductive so that heat can be conducted from said combing means to said hair via said thermally conductive combing teeth when said hair is being engaged under tension by said combing teeth.

U.S. Pat. No. 1,614,631, issued to Sendlbeck on Jan. 18, 1927, discloses a novel hair comb having a main section and an auxiliary section, both sections carrying teeth which may be adjusted toward and from each other in order to provide a coarse comb or a fine comb as may be desired.

U.S. Pat. No. 2,533,067, issued to Taren et al. on Dec. 5, 1950,discloses a teeth-locking comb constructed and arranged with fixed teeth and with spring-actuated clamping teeth for clamping hair in place and for holding the comb in an attractive position in the hair as an ornament.

U.S. Pat. No. 5,449,007, issued to Arnhols on Sep. 12, 1995,discloses a hair comb that includes moveable gripping elements for securing the hair comb in place in the user's hair. The hair comb comprises a main body including a plurality of teeth. A selected number of teeth include a longitudinal channel which is open along one side of the tooth. A gripping member including one or more gripping teeth is movably mounted in the main body. The gripping member is moveable from an inoperative position in which the gripping teeth are disposed within the longitudinal channels of respective teeth of the main body and a clamping position in which the gripping teeth extend outwardly from the longitudinal channels to clamp the user's hair between the gripping teeth and the adjacent teeth. A resilient member urges the gripping member to the retracted position. A latch releasably locks the gripping member in a clamping position. In a preferred embodiment of the invention, the latch is operative to lock the gripping members in a plurality of different positions.

U.S. Pat. No. 3,696,818, issued to Weber on Oct. 10, 1972, discloses a hair-drying comb having open teeth that is supplied with heated air which flows into the comb housing and through slots aligned with the openings in the teeth. Drying air is thereby directed laterally into the hair held between the teeth.

U.S. Pat. No. 4,421,129, issued to Wingard on Dec. 20, 1983,discloses shaped articles, such as hair brushes, combs and hair curlers, for rapid hair drying, molded in whole or in part of graft starch copolymer. Graft starch copolymers, such as base hydrolized starch-polyacrylonitrile, carbohydrate acrylic copolymer, modified carbohydrate derivatives, and combinations of polyacrylate and polyacrylamide, have superabsorbent properties. Graft starch copolymer is a blend of the natural polymer, starch, and synthetic polymers such as acrylamide and sodium or potassium acrylate. When used after a shower or after washing ones hair, these shaped articles, molded from graft starch copolymer, in accordance with the method of the present invention, will absorb essentially all moisture from the hair, upon contact, in a matter of a few minutes.

U.S. Pat. No. 2,463,893, issued to Hallnan on Nov. 9, 1965, discloses a plural comb unit with staggered tooth rows for cleaning and waving hair.

U.S. Pat. No. 2,425,435, issued to McArthur on Aug. 12, 1947, discloses a clamp comb.

U.S. Pat. No. 2,626,618, issued to Collision on Jan. 27, 1953, discloses a comb.

U.S. Pat. No. 5,062,435, issued to Ohtsuka on Nov. 5, 1991, discloses a hair comb with absorbent pad.

The foregoing patent and other information reflect the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides systems and methods for combing, drying, and straightening hair with a device having one or more rows of teeth. Additionally, this technology provides for an adjustable tension mechanism that provides for the compression of hair, thus wringing it of water and providing the ability for a user to also straighten his or her hair. Furthermore, this technology provides for combing, drying, and straightening hair without utilizing an electric or heating means.

In one exemplary embodiment, this technology provides an adjustable hair comb utilizing at least two adjacent rows of comb teeth. The adjustable hair comb includes a first row of comb teeth disposed upon a comb body in a fixed position relative to a comb handle, a second row of comb teeth disposed upon the comb body and configured to slide in a generally parallel manner alongside the first row of comb teeth, and an adjustable tension mechanism disposed upon the comb body and configured to provide a tension between the first row of comb teeth and the second row of comb teeth, thereby configured to compress hair at a variable level of tension and provide a wring effect.

The adjustable hair comb can include a tab disposed upon the comb handle, operable to regulate a position of the second row of comb teeth in relation to the first row of comb teeth, the tab operable by a digit of a user.

The hair passed through the adjustable hair comb is compressed between the first row of comb teeth and the second row of comb teeth to provide a wring effect on the hair and to facilitate the removal of water from the hair.

The first row of comb teeth and the second row of comb teeth can be slidably interconnected in a tongue and groove connection. Alternatively, the first row of comb teeth and the second row of comb teeth are slidably interconnected in a channel connection. Alternatively, the first row of comb teeth and the second row of comb teeth are slidably interconnected in a slot and rivet connection. Alternatively, the first row of comb teeth and the second row of comb teeth are slidably interconnected with one or more elastic band. As will be apparent to those in the art, alternative means can be utilized to provide the interconnectivity and slidability between the first and second rows of teeth.

The adjustable tension mechanism can include a spring to provide tension between the first row of comb teeth and the second row of comb teeth to compress and wring hair while it is combed, dried, and straightened. Alternatively, the adjustable tension mechanism can include at least one elastic band to provide tension between the first row of comb teeth and the second row of comb teeth to compress and wring hair while it is combed, dried, and straightened. As will be apparent to those in the art, alternative means can be utilized to provide the tension between the rows of teeth.

The teeth of the adjustable hair comb can include shapes of rectilinear, conical, triangular, and rounded. As will be apparent to those in the art, alternative shapes for the teeth can be utilized such that the teeth provide compression and facilitate a wringing effect.

The combing and drying of hair is facilitated without the use of an electrical source and a heat source.

In another exemplary embodiment, this technology provides a hair combing, drying, and straightening device utilizing at least one row of comb teeth. The device includes at least one row of comb teeth disposed upon a comb body in a fixed position relative to a comb handle and a plurality of flaps disposed upon the row of comb teeth. The flaps are elastic and flexible and are disposed on each tooth and configured to facilitate a wring effect to hair passed through the adjustable hair comb.

The plurality of flaps can include graduated flaps that are farther apart at each point of each tooth in the row of comb teeth and closer together at a base of each tooth in the row of comb teeth. Alternatively, the plurality of flaps can include non-graduated flaps.

The teeth in the row of comb teeth have an elongated cross section. Alternatively, the teeth in the row of comb teeth have an elliptical cross section. Alternatively, the teeth in the row of comb teeth have a star-shaped pattern. As will be apparent to those in the art, alternative patterns can be utilized.

In another exemplary embodiment, this technology provides a system for combing, drying, and straightening hair. The system includes an adjustable hair comb having a first row of comb teeth disposed upon a comb body in a fixed position relative to a comb handle, a second row of comb teeth disposed upon the comb body and configured to slide in a generally parallel manner alongside the first row of comb teeth, and a manual, adjustable tension mechanism disposed upon the comb body and configured to provide a tension between the first row of comb teeth and the second row of comb teeth, thereby configured to compress hair at a variable level of tension and provide a wring effect, and a water displacement solution for use on the adjustable hair comb to displace water as the comb is passed through hair. The combing and drying of hair with the system is facilitated without the use of an electrical source and a heat source. The adjustable hair comb can be manufactured from a non- water-absorbent material. The system can further include a hair treatment solution such as a water repellant, oil, conditioner, dye, detangler, and shampoo.

In yet another exemplary embodiment, this technology provides a method for combing, drying, and straightening hair utilizing at least two adjacent rows of comb teeth. The method includes utilizing an adjustable comb having a first row of comb teeth disposed upon a comb body in a fixed position relative to a comb handle and a second row of comb teeth disposed upon the comb body and configured to slide in a generally parallel manner alongside the first row of comb teeth, utilizing a manual, adjustable tension mechanism disposed upon the comb body and configured to provide a tension between the first row of comb teeth and the second row of comb teeth, thereby configured to compress hair, and compressing and wringing hair in between the first row of comb teeth and the second row of comb teeth.

The method can further include utilizing a tab located on the comb handle, regulating a position of the second row of comb teeth in relation to the first row of comb teeth, and operating the tab by a single digit of a user.

The method can further include selectively determining the variable tension to set between the first row of comb teeth and the second row of comb teeth and regulating the variable tension between the first row of comb teeth and the second row of comb teeth.

The method can further include inserting the adjustable comb into a body of hair, combing the hair with the adjustable comb, providing compression between the first row of comb teeth and the second row of comb teeth, and wringing water from the hair.

The method can further include operatively depressing the tab and regulating the tension between the first row of comb teeth and the second row of comb teeth.

The method can further include operatively straightening hair with repeating comb strokes with the adjustable comb.

The method of combing and drying of hair is facilitated without the use of an electrical source and a heat source.

Advantageously, this technology provides for the combing, drying, and straightening of hair without the need to utilize an electric or heating means. Additionally, this technology provides a solution that effectively and efficiently compresses and wrings out water located in hair after it has been washed or otherwise wetted. Furthermore, this technology provides a compact, portable hair combing device that includes a variable, adjustable tension providing a variety of tensions as desired by a user. Also advantageous is that this technology provides tension between the two rows of comb teeth in a manner that is operable preferably by a single digit of a user.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like system components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides systems and methods for combing, drying, and straightening hair with a device having one or more rows of teeth. Additionally, this technology provides for a dynamic adjustable tension mechanism that provides for the compression of hair, thus wringing it of water and providing the ability for a user to also straighten his or her hair. Furthermore, this technology provides for combing, drying, and straightening hair without utilizing an electric or heating means.

Figure 1:
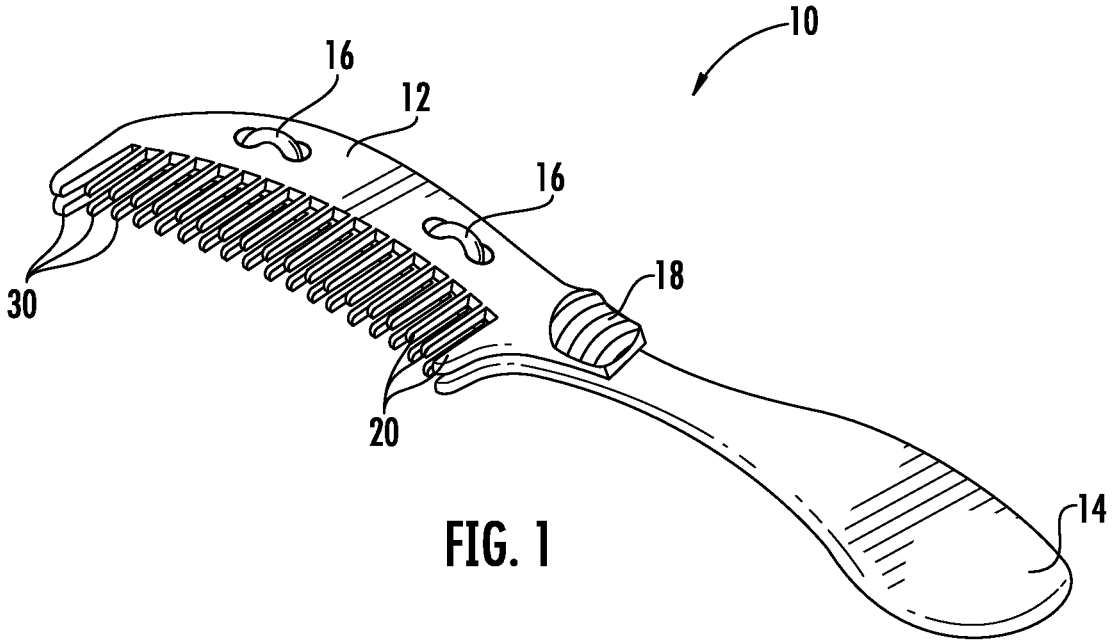
FIG. 1 is a front perspective diagram of a hair combing, drying, and straightening device according to an embodiment of the technology described herein; illustrating, in particular, a comb having two rows of generally parallel teeth, a means of adjusting the second row of teeth in a generally parallel manner about the first row of teeth, and a tension mechanism.

Referring now to FIG. 1, a front perspective diagram of a hair combing, drying, and straightening device 10 is shown. The hair comb device 10 includes a body 12 and a handle 14 with which a user grips the comb. The hair comb device 10 includes at least two adjacent rows of comb teeth 20, 30 disposed upon the body 12. A first row of comb teeth 30 is disposed upon the comb body 12 in a fixed position relative to a comb handle 14. The first row of comb teeth 30 is integrally formed with comb handle 14 and utilized to comb hair, separating various strands of hair as they are passed through the hair comb device 10. A second row of comb teeth 20 is disposed upon the comb body 12 and configured to slide in a generally parallel manner alongside the first row of comb teeth 30, guided, for example, by a tongue-and-groove connection, or the like.

The hair comb device 10 further includes an adjustable tension mechanism 16. The tension mechanism 16 operates to provide a resistant tension between the first row of comb teeth 30 and the second row of comb teeth 20 thereby configured to compress hair at a variable level of tension and provide a wring effect. The tension mechanism 16, as engaged, for example, by the tab 18, affects the position of the second row of comb teeth 20 in relation to the first row of comb teeth 30. This varied positioning allows a user to compress hair between the first row of comb teeth 30 and the second row of comb teeth 20. The tension mechanism 16 provides the user with the ability to manually open all of the rows of teeth to allow for efficient penetration of the hair and then to subsequently release the tension mechanism 16 and allow the tension to wring out water from hair as the hair comb device 10 is combed through the hair.

The hair comb device 10 also includes a means of adjusting the second row of teeth 20 about the first row of comb teeth 30 in a generally parallel manner. This means of adjustment, in one embodiment, is with the use of a tab 18. The tab 18 shown is located in a user-convenient place on either or both sides of the comb. The tab 18 is operable by a user to slide the second row of teeth 20 and vary the distance between the first row of teeth 30 and the second row of teeth 20. The tab 18 is movable by one digit, typically the thumb 24, on the hand 22 of the user while the hair comb device 10 is being gripped by the user. As the tab 18 is depressed, the second row of comb teeth 20 slides adjacent to the first row of teeth 30.

Figure 2:
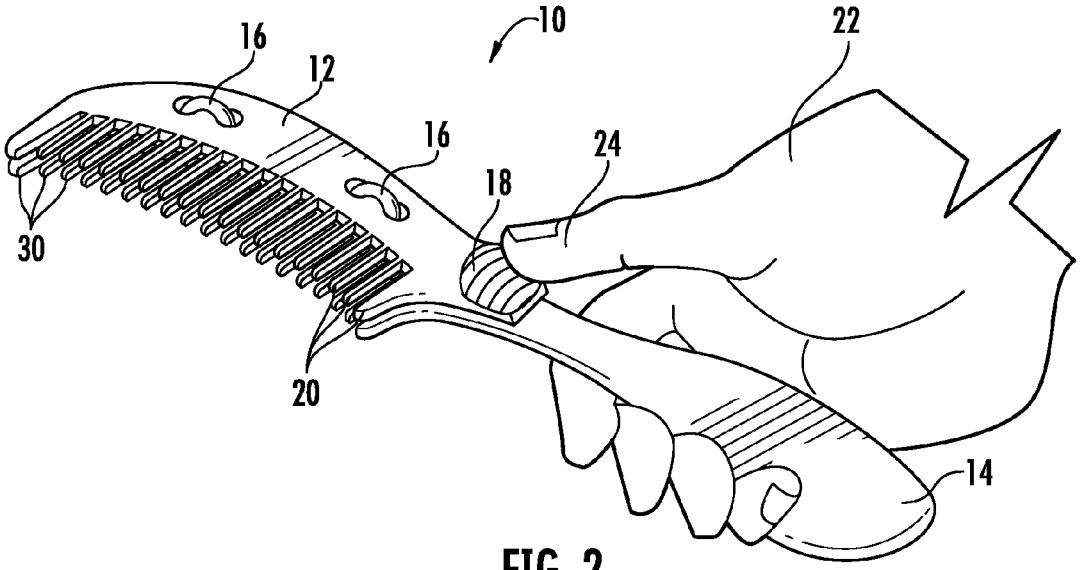
FIG. 2 is a front perspective diagram of the hair combing, drying, and straightening device of FIG. 1, illustrating, in particular, the hand-operability of the device and tension mechanism.
Figure 4:
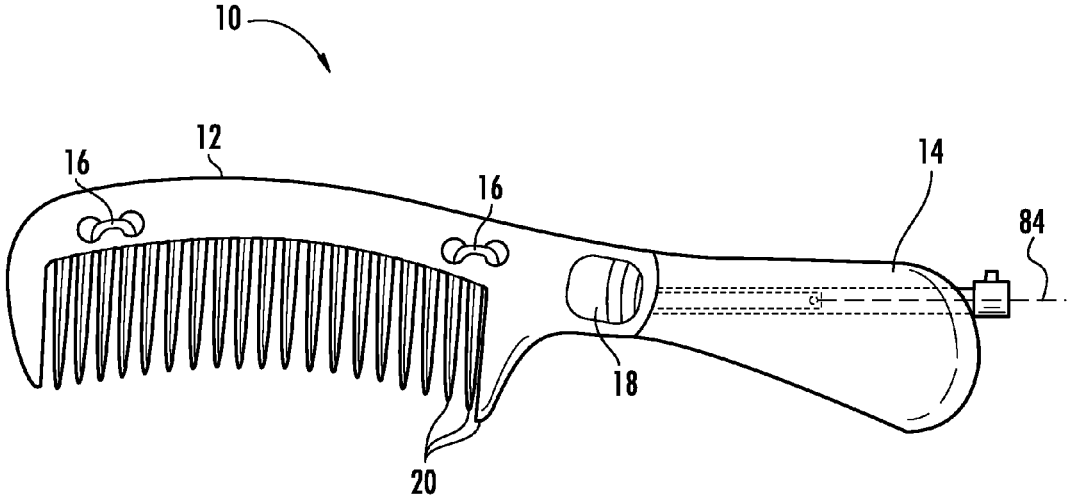
FIG. 4 is a front planar view of the hair combing, drying, and straightening device of FIG. 1, illustrating, in particular, the tension mechanism utilized with no tension on the hair.
Figure 5:
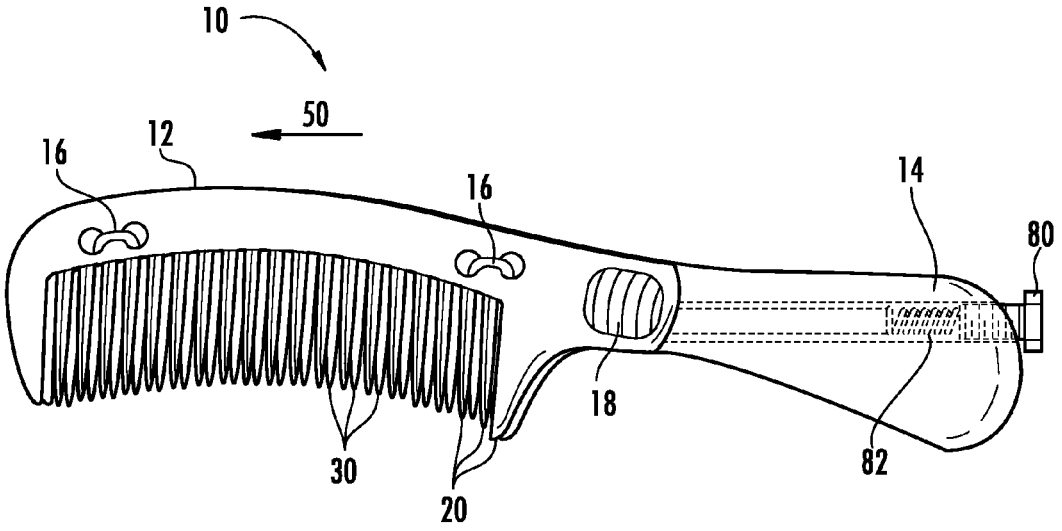
FIG. 5 is a front planar view of the hair combing, drying, and straightening device of FIG. 1, illustrating, in particular, the tension mechanism utilized with tension on the hair.

Referring now to FIG. 2, the hand-operability of the hair comb device 10 and tension mechanism 16 is shown. The hair comb device 10 operates between a manipulated state (as shown in FIG. 4, for example) and a home state (as shown in FIG. 5, for example). Alternatively, in a varied embodiment, the manipulated state and the home state can be configured inversely.

Switching between the manipulated state and the home state can be selectively managed by a user gripping the hair comb device 10 by the handle 14, grasping the handle 14 with the hand 22 and operating the tab 18 with thumb 24, for example.

In a manipulated state, with the tension against hair temporarily removed by the counterforce depression of tab 18 and movement of the second row of comb teeth 20, the hair comb device 10 allows for the unconstrained penetration of the hair. The hair comb device 10 in this manipulated state can be placed in hair and then the tab 18 can be released such that the tension compresses the hair between the first row of comb teeth 30 and the second row of comb teeth 20 to wring the hair as the hair comb device 20 is passed through.

When the hair comb device 10 is in a home or non-manipulated state, small gaps between each pairing of teeth between the rows 20, 30 exist to enable hair to pass through as the hair is being combed, thus providing the wringing action. It is to be understood by those of ordinary skill in the art that the initial positions of the first row of teeth 30 and the second row of teeth 20 can be varied as to what constitutes the at-rest or non-manipulated state and what is the manipulated state. It also is to be understood by those of ordinary skill in the art that the direction of movement creating the tension may be varied, including for example, push and/or pull motions utilizing a tab 18, or the like, or a twisting motion utilizing a knob, grip, or the like.

Figure 3:
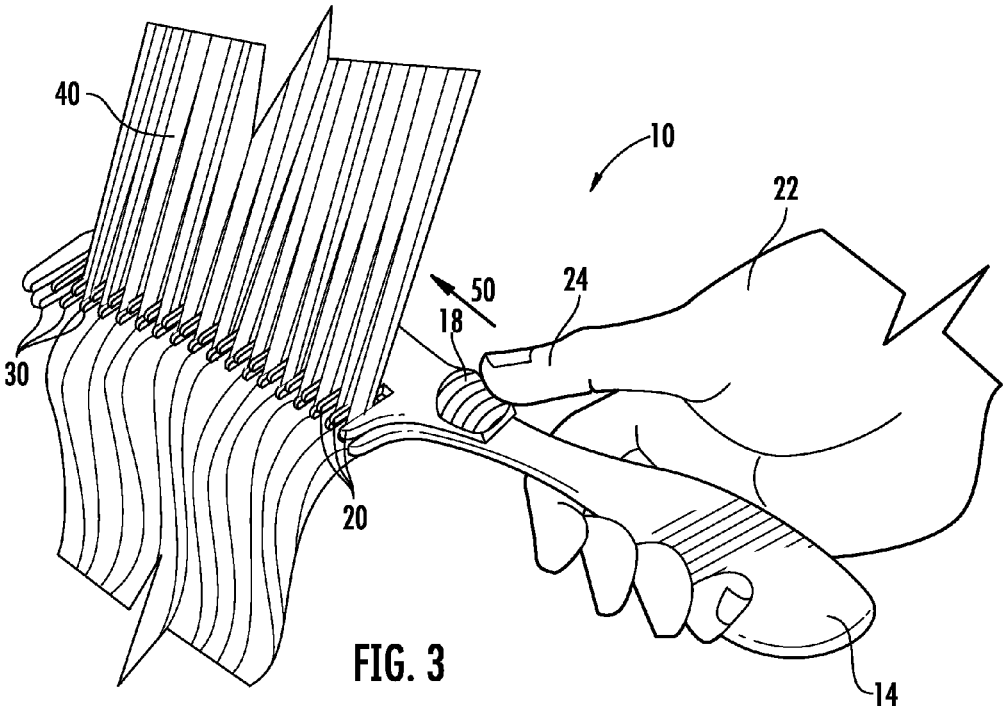
FIG. 3 is a front perspective diagram of the hair combing, drying, and straightening device of FIG. 1, shown in use illustrating, in particular, the tension mechanism utilized to comb, dry, and straighten hair.

Referring now to FIG. 3, the hair combing, drying, and straightening device 10 of FIG. 1 is shown in use. As the hair comb device 10 is passed through strands of hair 40 by an operator, it can be utilized for combing, drying, and straightening the hair 40. The user can operate the tab 18 in the direction of arrow 50 to open the hair comb device 10 for insertion into the hair 40. The tab 18 is then released and the tension compresses the hair 40 between the first row of comb teeth 30 and the second row of comb teeth 20 as the hair comb device 10 is pulled downwardly along the strands of hair 40. This technique removes water from the hair 40 with a wringing effect.

Referring now to FIG. 4, the hair combing, drying, and straightening device 10 of FIG. 1 is shown in a manipulated, open state such that it can be placed into strands of hair. The hair comb device 10 can be placed into the manipulated state by depressing the tab 18 to provide a counterforce against the tendency of the second row of comb teeth 20 to return toward the handle 14 end of the comb. In this manipulated, open state no tension is placed by the second row of comb teeth 20 against the hair.

Referring now to FIG. 5, the hair combing, drying, and straightening device 10 of FIG. 1 is shown in a non-manipulated, home state. The hair comb device enters this state when the tab is released and the second row of comb teeth compresses against the hair as a result of the tension mechanism 16. The user can operate the tab 18 in the direction of arrow 50 to open the hair comb device 10 for insertion into the hair 40. A tension exists in a direction opposite arrow 50. Alternatively, in a varied embodiment, the manipulated state and the home state can be configured inversely.

Figure 6:
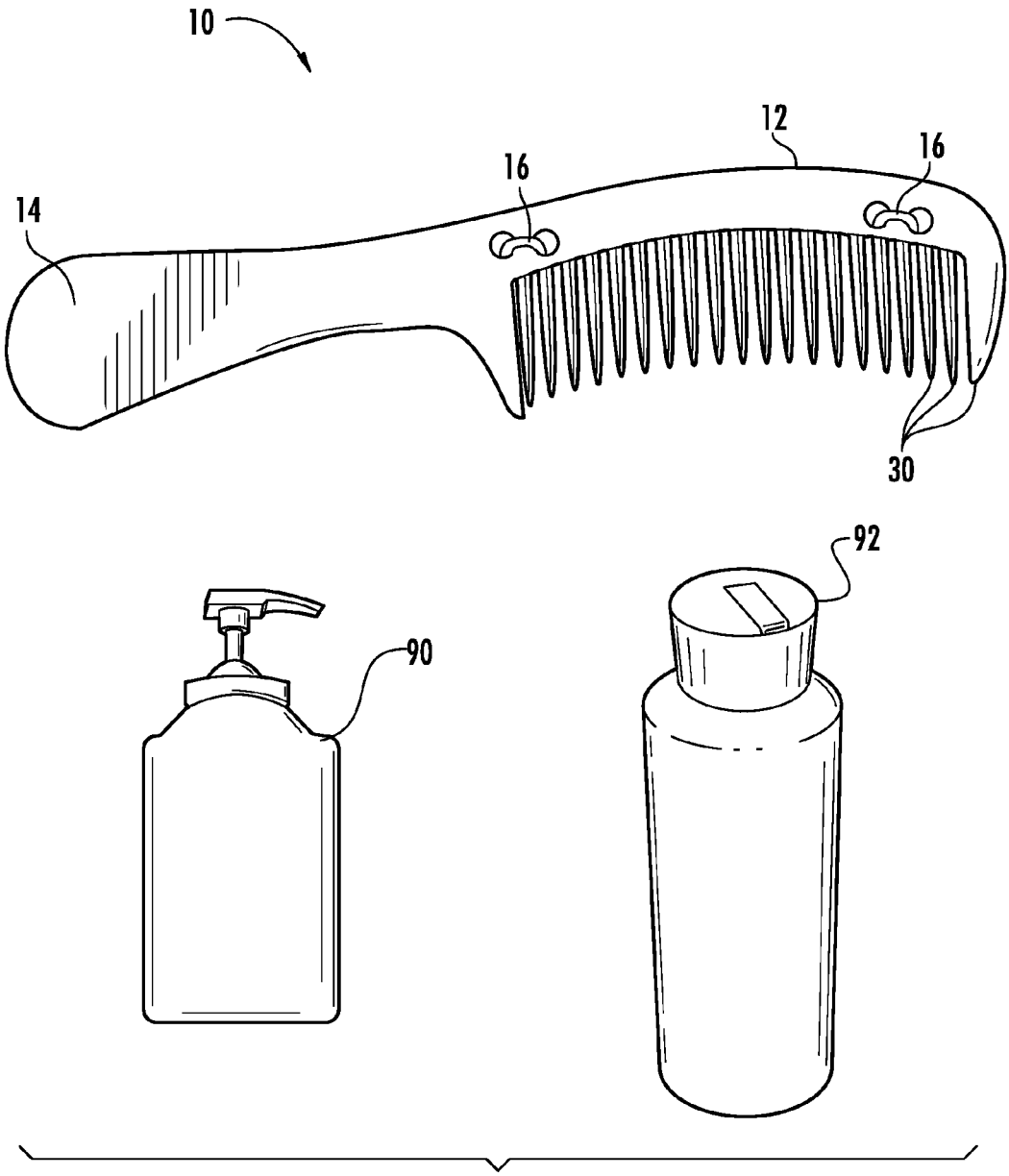
FIG. 6 is a rear planar view of the hair combing, drying, and straightening device of FIG. 1.

Referring now to FIG. 6, a rear view of the hair combing, drying, and straightening device 10 of FIG. 1 is shown. As shown the hair comb device is in a manipulated state and the second row of comb teeth 20 are located directly behind the first row of comb teeth 30.

Figure 7:
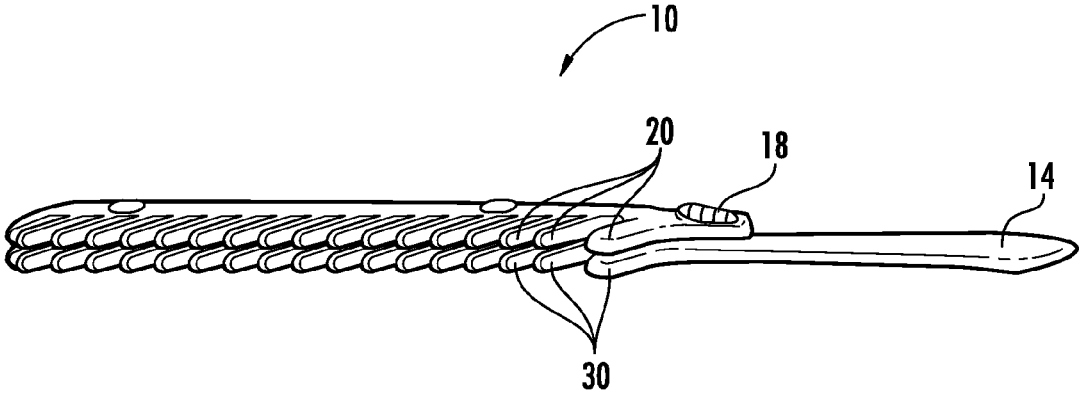
FIG. 7 is a bottom perspective view of the hair combing, drying, and straightening device of FIG. 1.
Figure 8:
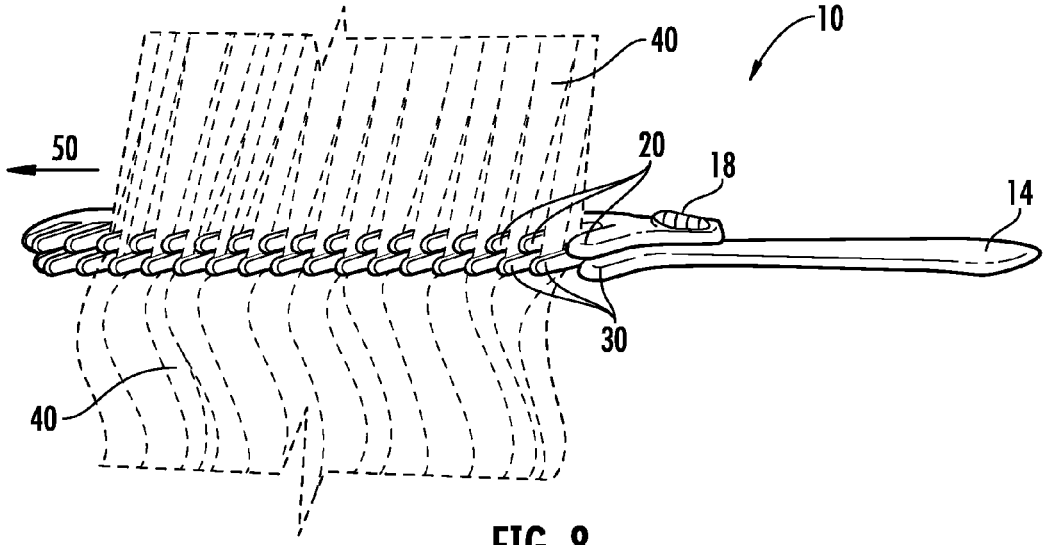
FIG. 8 is a bottom perspective view of the hair combing, drying, and straightening device of FIG. 1, illustrating, in particular, the tension mechanism utilized with tension and combing, drying, and straightening hair.

Referring now to FIGS. 7 and 8, bottom views of the hair combing, drying, and straightening device 10 of FIG. 1 is shown. In FIG. 7, the hair comb device 10 is shown in a manipulated, open state for placement within hair. In FIG. 8, the hair comb device 10 is shown in use in hair in a non-manipulated, home state where tension compresses the hair between the first row of comb teeth 30 and the second row of comb teeth 20. This compression against the hair provides a wringing effect on the hair and is useful in combing, drying, and straightening the hair.

In one alternative embodiment, a channel design for the rows of teeth 20, 30 is used. In yet another alternative embodiment, a slot and rivet system is used. It is to be understood by those of ordinary skill in the art that the motion between the first row of comb teeth 30 and the second row of teeth 20 is accomplished by a variety of means so long as the means is capable of holding tension either created during movement or while at rest, thus being able to facilitate compression of the passing hair passing through the comb and extracting excess water from the hair.

The hair comb device 10, in various embodiments, includes preset positions along the comb body 12 in which a coiled spring 82, elastic band 16, or the like is received. In one alternative embodiment, the means of adjusting the second row of comb teeth 20 about the first row of comb teeth 30 includes a rotating, cylindrical grip 80 located along the comb handle 14 with one end flat and the other end sloped, resulting in a varying length when rotated and notched to receive an end of the coiled spring, elastic band, or the like.

In alternative embodiments, more than two rows of comb teeth are used to add additional layering of teeth to compress and straighten hair. The tension mechanism 16 is an elastic band 84 in one embodiment. Alternative embodiments include, for example, but not limited to, a coiled spring 82, a compressible material, a pneumatic cylinder, and a hydraulic cylinder as a tension mechanism 16. The degree of compression or tension formed in using the tension mechanism 16 is varied, for example, but not limited to, lengthening or shortening a coiled spring 82 or elastic band. Thus, a plurality of varied tensions is provided. Tension is altered by a user, for example, based on the accommodation of various hair textures, lengths, thicknesses, and other personal preferences.

In one alternative embodiment each tooth in the second row of teeth 20 has a triangular shape. The triangular shape of each individual tooth in the hair comb device 10 provides an efficient wringing effect on the hair and facilitates comb-through penetration of the hair.

In one alternative embodiment, the comb teeth are designed to provide additional compression between the first row of comb teeth 30 and the second row of comb teeth 20. For example, comb teeth are rounded on the sides parallel to an adjacent row, yet triangularly shaped with the point of the triangle oriented such that it provides optimal hair penetration. In such an embodiment, as the hair comb device 10 is passed through the hair of a user, the hair experiences compression that increases as the gap between the rows increasingly gets smaller. In various other alternative embodiments, the hair comb teeth are rectilinear, conical, rounded, etc. Additionally, a combination of these teeth types is used in yet another alternative embodiment.

In yet another alternative embodiment, with a single or more rows of teeth, the teeth further include flaps in parallel with the teeth to provide a squeegee effect as hair passes between the comb teeth. The flaps narrow the traditional gap located between the comb teeth. The gap can be even narrower as the teeth approach the body 12 of the hair comb device 10. The flaps are thin and flexible to slightly yield as hair is passed through the combing device.

Figure 9:
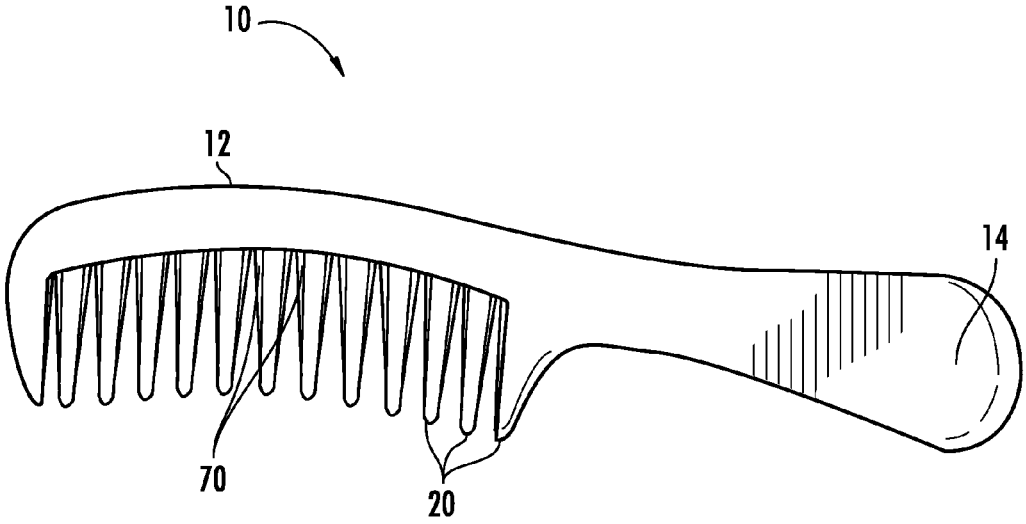
FIG. 9 is a front planar view of a hair combing, drying, and straightening device according to an embodiment of the technology described herein; illustrating, in particular, a comb having one row of generally parallel teeth, wherein each tooth contains flaps to aid in wringing hair of water as it is combed.
Figure 10A:
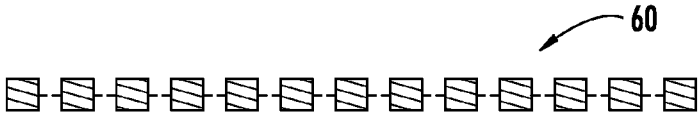
FIGS. 10A, 10B, 10C, 10D, and 10E are cross-sectional diagrams of the row of comb teeth and flaps from a bottom view of the teeth, illustrating, in particular, the varied shapes, sizes, and patterns of the teeth and flaps.
Figure 10B:
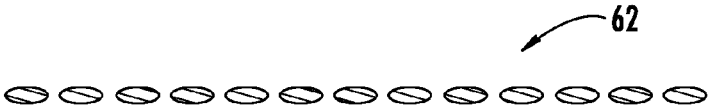
Figure 10C:
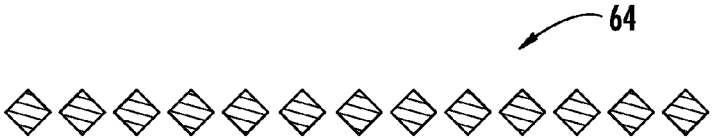
Figure 10D:
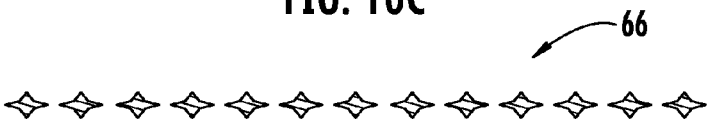
Figure 10E:
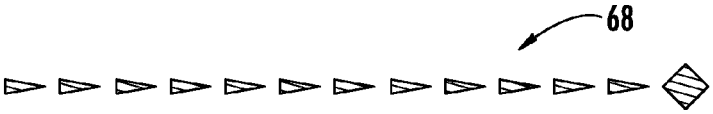

Referring now to FIG. 9, a hair combing, drying, and straightening device 10 utilizing at least one row of comb teeth is shown. Device 10 includes at least one row of comb teeth 20 disposed upon a comb body 12 in a fixed position relative to a comb handle 14. Flaps 70 are disposed upon the row of comb teeth 20. The flaps 70 are elastic and flexible. The flaps 70 are located on each tooth and are configured to facilitate a wringing effect to hair passed through the adjustable hair comb 10.

The flaps 70 can include graduated flaps that are farther apart at each point of each tooth in the row of comb teeth 20 and closer together at a base of each tooth in the row of comb teeth 20. Alternatively, the plurality of flaps can include non-graduated flaps.

The teeth in the row of comb teeth can have an elongated cross section, an elliptical cross section, a star-shaped pattern, or the like. As will be apparent to those in the art, alternative patterns can be utilized.

Referring now to FIGS. 10A, 10B, 10C, 10D, and 10E, various teeth and flap cross section patterns are depicted. Pattern 60 depicts generally square teeth with flaps. Pattern 62 depicts oval or elliptical teeth. Pattern 64 depicts diamond-shaped teeth. Pattern 64 depicts generally star-shaped teeth. Pattern 68 depicts teeth having a generally triangular cross section. Pattern 68 also depicts varying patterns in the same row of comb teeth.

In other alternative embodiments, the hair comb device 10 is manufactured from non-water-absorbent materials or materials suitable for water displacement. Additionally, in other embodiments, the hair comb is used in conjunction with a water displacement solution 92 (such as an alcohol-based hair care product) that hastens the removal of water from the hair with both water displacement and evaporation techniques. Additionally, a hair treatment solution 90 can be utilized. The hair treatment solution can be one or more of a water repellant, oil, conditioner, dye, detangler, and shampoo.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. An adjustable hair combing, drying, and straightening device utilizing at least two adjacent rows of comb teeth, the device comprising:

a comb body;

an elongated comb handle outwardly extended from the comb body;

a first row of comb teeth disposed upon the comb body in a fixed position relative to the comb handle;

a second row of comb teeth disposed upon the comb body and configured to slide in a generally parallel manner alongside the first row of comb teeth;

a dynamically adjustable tension mechanism disposed upon the comb body and configured to provide a tension longitudinally with a direction of the first row of comb teeth and the second row of comb teeth, in a non-manipulated, home state having a tension while the device is at rest, and compression of hair between the first row of comb teeth and the second row of comb teeth, thereby configured to allow a user to adjust the dynamically adjustable tension mechanism between the rows of teeth and, thus, the resultant varied degree of hair compression to compress hair between teeth under tension at a variable level of tension and provide a wring effect; and a single tab, operable by a single digit of a user, disposed upon the second row of comb teeth, operable to regulate a position of the second row of comb teeth in relation to the first row of comb teeth, to a manipulated, open state, and configured to selectively, temporarily remove the tension created by the dynamically adjustable tension mechanism such that the device is thereby placed in hair and the tab subsequently released, to return the device to the non-manipulated, home state, such that the tension compresses the hair between the first row of comb teeth and the second row of comb teeth to wring the hair as the hair comb device is passed through in push and/or pull motions of the device while the tab is utilized;

wherein actuation of the device, to regulate a position of the second row of comb teeth in relation to the first row of comb teeth, is operable solely by a single digit of a user, disposed upon the second row of comb teeth;

wherein the hair passed through the adjustable hair comb is compressed between the first row of comb teeth and the second row of comb teeth to provide a wring effect on the hair and to facilitate the removal of water from the hair.

2. The adjustable hair comb of claim 1, wherein the first row of comb teeth and the second row of comb teeth are slidably interconnected with an elastic coupling.

3. The adjustable hair comb of claim 1, wherein the adjustable tension mechanism comprises a spring to provide tension between the first row of comb teeth and the second row of comb teeth to compress and wring hair while it is combed, dried, and straightened.

4. The adjustable hair comb of claim 1, wherein the adjustable tension mechanism comprises an elastic band to provide tension between the first row of comb teeth and the second row of comb teeth to compress and wring hair while it is combed, dried, and straightened.

5. The adjustable hair comb of claim 1, wherein the teeth in at least one of the first row of comb teeth and the second row of comb teeth are rectilinear.

6. The adjustable hair comb of claim 1, wherein the teeth in at least one of the first row of comb teeth and the second row of comb teeth are conical.

7. The adjustable hair comb of claim 1, wherein the teeth in at least one of the first row of comb teeth and the second row of comb teeth are triangular.

8. The adjustable hair comb of claim 1, wherein the teeth in at least one of the first row of comb teeth and the second row of comb teeth are rounded.

9. The adjustable hair comb of claim 1, wherein the combing and drying of hair is facilitated without the use of an electrical source and a heat source.

10. A system for combing, drying, and straightening hair, the system comprising:

an adjustable hair comb having a comb body; an elongated comb handle outwardly extended from the comb body; a first row of comb teeth disposed upon the comb body in a fixed position relative to the comb handle, a second row of comb teeth disposed upon the comb body and configured to slide in a generally parallel manner alongside the first row of comb teeth; a dynamically adjustable tension mechanism disposed upon the comb body and configured to provide a tension longitudinally with a direction of the first row of comb teeth and the second row of comb teeth, in a non-manipulated, open state having a tension while the device is at rest, and compression of hair between the first row of comb teeth and the second row of comb teeth, thereby configured to allow a user to adjust the dynamically adjustable tension mechanism between the rows of teeth and, thus, the resultant varied degree of hair compression to compress hair between teeth under tension at a variable level of tension and provide a wring effect; and a single tab, operable by a single digit of a user, disposed upon the second row of comb teeth, operable to regulate a position of the second row of comb teeth in relation to the first row of comb teeth, to a manipulated, open state, and configured to selectively, temporarily remove the tension created by the dynamically adjustable tension mechanism such that the device is thereby placed in hair and the tab subsequently released, to return the device to the non-manipulated, home state, such that the tension compresses the hair between the first row of comb teeth and the second row of comb teeth to wring the hair as the hair comb device is passed through in push and/or pull motions of the device while the tab is utilized;

wherein actuation of the device, to regulate a position of the second row of comb teeth in relation to the first row of comb teeth, is operable solely by a single digit of a user, disposed upon the second row of comb teeth;

wherein the hair passed through the adjustable hair comb is compressed between the first row of comb teeth and the second row of comb teeth to provide a wring effect on the hair and to facilitate the removal of water from the hair.

11. The system of claim 10, wherein the adjustable hair comb is comprised of a non-water-absorbent material.

12. The system of claim 10, further comprising:

a hair treatment solution, wherein the hair treatment solution is one of a water repellant, oil, conditioner, dye, detangler, or shampoo; and a water displacement solution for use on the adjustable hair comb to displace water as the comb is passed through hair;

wherein the combing and drying of hair is facilitated without the use of an electrical source and a heat source.

13. The system of claim 10, wherein the first row of comb teeth and the second row of comb teeth are slidably interconnected with an elastic coupling.

14. The system of claim 10, wherein the adjustable tension mechanism comprises a spring to provide tension between the first row of comb teeth and the second row of comb teeth to compress and wring hair while it is combed, dried, and straightened.

15. The system of claim 10, wherein the adjustable tension mechanism comprises an elastic band to provide tension between the first row of comb teeth and the second row of comb teeth to compress and wring hair while it is combed, dried, and straightened.

16. The system of claim 10, wherein the teeth in at least one of the first row of comb teeth and the second row of comb teeth are comprised of at least one shape selected from the group consisting of rectilinear, conical, triangular, and rounded.

17. The system of claim 10, wherein the combing and drying of hair is facilitated without the use of an electrical source and a heat source.

18. A method for combing, drying, and straightening hair, the method comprising:

utilizing an adjustable hair combing, drying, and straightening device utilizing at least two adjacent rows of comb teeth, the device comprising: a comb body; an elongated comb handle outwardly extended from the comb body; a first row of comb teeth disposed upon the comb body in a fixed position relative to the comb handle; a second row of comb teeth disposed upon the comb body and configured to slide in a generally parallel manner alongside the first row of comb teeth; a dynamically adjustable tension mechanism disposed upon the comb body and configured to provide a tension longitudinally with a direction of the first row of comb teeth and the second row of comb teeth, in a non-manipulated, home state having a tension while the device is at rest, and compression of hair between the first row of comb teeth and the second row of comb teeth, thereby configured to allow a user to adjust the dynamically adjustable tension mechanism between the rows of teeth and, thus, the resultant varied degree of hair compression to compress hair between teeth under tension at a variable level of tension and provide a wring effect; and a single tab, operable by a single digit of a user, disposed upon the second row of comb teeth, operable to regulate a position of the second row of comb teeth in relation to the first row of comb teeth, to a manipulated open state, and configured to selectively, temporarily remove the tension created by the dynamically adjustable tension mechanism such that the device is thereby placed in hair and the tab subsequently released, to return the device to a non-manipulated, home state, such that the tension compresses the hair between the first row of comb teeth and the second row of comb teeth to wring the hair as the hair comb device is passed through in push and/or pull motions of the device while the tab is utilized; and operating the tab to regulate the position of the second row of comb teeth in relation to the first row of comb teeth to operatively provide a tension and compression of hair as the device is pulled through hair between the first row of comb teeth and the second row of comb teeth;

wherein actuation of the device, to regulate a position of the second row of comb teeth in relation to the first row of comb teeth, is operable solely by a single digit of a user, disposed upon the second row of comb teeth;

wherein the hair passed through the adjustable hair comb is compressed between the first row of comb teeth and the second row of comb teeth to provide a wring effect on the hair and to facilitate the removal of water from the hair.

* * * * *